US005392841A

United States Patent [19]

Anderson et al.

[11] Patent Number: 5,392,841

[45] Date of Patent: Feb. 28, 1995

[54] MOUNTING EXPENDABLE CORE IN DIE CAST DIE

[75] Inventors: Stuart W. Anderson, Bedford; Bradley C. Menaugh, Mitchell; Donnie D. Rhum, Bedford, all of Ind.

[73] Assignee: General Motors Corporation, Detroit, Mich.

[21] Appl. No.: 258,319

[22] Filed: Jun. 10, 1994

[51] Int. Cl.[6] ..... B22C 9/10

[52] U.S. Cl. ..... 164/113; 164/137; 164/253; 164/312; 164/340

[58] Field of Search ..... 164/137, 30, 31, 32, 164/340, 113, 253, 312

[56] References Cited

U.S. PATENT DOCUMENTS

| | | | |
|---|---|---|---|
| 4,008,748 | 2/1977 | Gunnergaard | 164/30 |
| 4,453,300 | 6/1984 | Klimek et al. . | |
| 4,848,440 | 7/1989 | Hunter | 164/253 |
| 5,076,342 | 12/1991 | Johansen | 164/137 |
| 5,178,202 | 1/1993 | Dannoura et al. | 164/112 |

FOREIGN PATENT DOCUMENTS

| | | | |
|---|---|---|---|
| 60-102250 | 6/1985 | Japan | 164/137 |
| 62-207531 | 9/1987 | Japan | 164/113 |
| 1-150429 | 6/1989 | Japan | 164/340 |
| 1072984 | 2/1984 | U.S.S.R. | 164/137 |

*Primary Examiner*—J. Reed Batten, Jr.
*Attorney, Agent, or Firm*—Lawrence B. Plant

[57] ABSTRACT

An expendable core is positioned in the molding cavity of a die casting die including hollow mounting pins affixed to the die which mate with recesses formed in the expendable core. Vacuum applied to the recesses through the hollow mounting pins anchors the core in the die cavity.

17 Claims, 2 Drawing Sheets

MOUNTING EXPENDABLE CORE IN DIE CAST DIE

This invention relates to method and apparatus for positioning and anchoring an expendable core in the molding cavity of a die cast die, and more particularly to casting a liquid-cooled, engine block utilizing such method and apparatus.

BACKGROUND OF THE INVENTION

It is known to die cast or squeeze cast a variety of hollow metal castings utilizing expendable cores which are subsequently removed from the casting to leave voids therein. Expendable cores may comprise any of a variety of materials which can withstand the heat of casting but can be readily removed thereafter. Common such cores comprise salt, resin-bonded sand or the like. Following casting and solidification of the metal, the expendable core is removed, e.g., by dissolution for salt cores or vibration for sand cores. Expendable cores have been used to cast a variety of products including blocks for liquid-cooled internal combustion engines.

It is essential that the cores be precisely located and securely anchored in the die cavity in order to cast the part to the proper dimension, and to preclude any shifting of the core during the introduction of the metal. The proper positioning and anchoring of the cores in the die cavity can be a complicated procedure particularly in the manufacture of internal combustion engine blocks having cooling jackets in close proximity to the combustion chamber and separated therefrom by only a thin wall of metal. One technique for mounting expendable cores for use in forming cooling jackets in engine blocks is disclosed in Koch U.S. Pat. No. 4,981,168. Koch provides a resin-bonded sand core having a print-out portion at one end thereof which is adapted to fit into a core print in one of the die parts. A mandrel used to form the block's combustion chamber(s) has a flange(s) thereon which holds the print-out in place in the core print. Locating pins extend into the print cavity for bridging any gap between the print-out portion of the core and the print cavity in the die hence eliminating any "loose fit" therein. The mandrel may hold a cylinder liner (e.g., a cast iron sleeve for use with an aluminum block), and is adapted to fit over a dowel provided in one of the die parts. The mandrel is clamped in the die between two opposing die parts. The core and mandrel are assembled outside of the die before being placed on the dowel. After casting, the mandrel remains with the casting until it is removed and reused. For forming engine blocks having plural combustion chambers, a secondary mandrel frame is provided which supports a separate mandrel for each cylinder and a plural-cylinder core.

It is an object of the present invention to provide an uncomplicated method and apparatus for simply, quickly and accurately positioning an expendable core in a die casting die, and anchoring it therein against movement during the casting cycle.

It is a further object of the present invention to provide such a method and apparatus for positioning and anchoring an expendable sand-core in the formation of a cooling jacket in an internal combustion engine block. These and other objects and advantages of the present invention will become more readily apparent from the detailed description thereof which follows.

BRIEF DESCRIPTION OF THE INVENTION

The invention contemplates method and apparatus for positioning an expendable core in a molding cavity defined by a plurality of die segments forming a permanent molding die (i.e., a die casting or squeeze casting die). At least one of the die segments has a passageway formed therein which is connected to a source of vacuum. At least one hollow mounting pin, having a central bore extending therethrough, projects from a face of such die segment into the molding cavity and has its central bore aligned with the passageway in the die segment. The core has a recess formed therein which conforms substantially to the external shape of the hollow mounting pin, and is adapted to receive such pin in close-fitting relation. The core is then positioned on the die segment such that the pin nests within the recess. Vacuum drawn through the passageway and the pin's bore securely anchors the core in place. The recess in the core will preferably be deeper than the length of the hollow pin so as to provide a large interior surface area for the vacuum to act on. Porous cores (e.g., resin-bonded sand) will preferably have the interior surface of the recess treated (e.g., coated, impregnated, etc.) to reduce the porosity of such surface, and thereby enhance the holding power of the vacuum.

For casting internal combustion engine blocks, the die casting die includes a permanent metal mandrel for forming each of the block's combustion chambers. The core for forming the block's cooling jacket has a mounting end, a distal end remote from the mounting end, and an internal annular wall extending between the mounting and distal ends. The core is positioned such that annular wall of the core circumscribes the mandrel but is spaced therefrom to define a region of the molding cavity for forming the cylinder wall of the block. The pin-receiving recess is formed in the mounting end of the core, and the mounting pin will preferably project from the same die segment as the mandrel. Alternatively the pin could project from a die segment directly opposite to the die segment carrying the mandrel. Preferably, the core will include at least one tab projecting from the mounting end of the core and defining a print-out which nests within a depression defining a core print in the die segment to which it is anchored, e.g., the die segment from which the mandrel projects. Most preferably, the hollow anchoring pin projects from the floor of the depression and mates with a recess formed in the tab that mates with the depression.

After the core has been positioned about the mandrel, sufficient vacuum (e.g., ca. 26 in. of Hg) is drawn through the passageway and hollow mounting pin to draw and hold the core securely in position. The die is then closed and molten metal introduced into the molding cavity therein. Following solidification of the metal, the die is opened and the finished casting stripped from the mandrel. If a cast iron cylinder liner is used, the liner will remain with the casting. At this time, the tabs will project from the core through openings formed in the surface of the casting. When the tabs are removed, the openings in such surface of the block are exposed and are used as outlets from the water jacket through which the expendable core is removed.

BRIEF DESCRIPTION OF THE DRAWING

The invention will better be understood when considered in the light of the following detailed description of a specific embodiment thereof which is given hereafter in conjunction with the several Figures in which.

DETAILED DESCRIPTION OF A SPECIFIC EMBODIMENT

Figure 1:
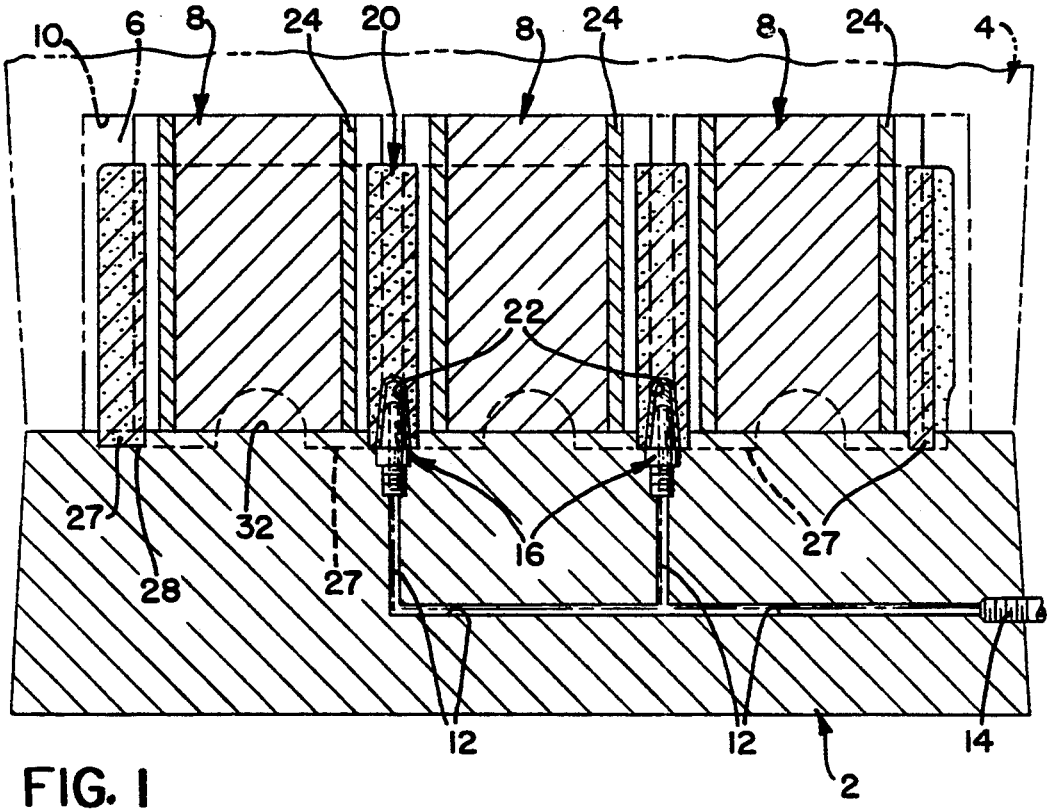
FIG. 1 illustrates a side, sectioned view of a die casting die and expendable core mounted in accordance with the present invention and taken in the direction 1—1 of FIG. 3.
Figure 2:
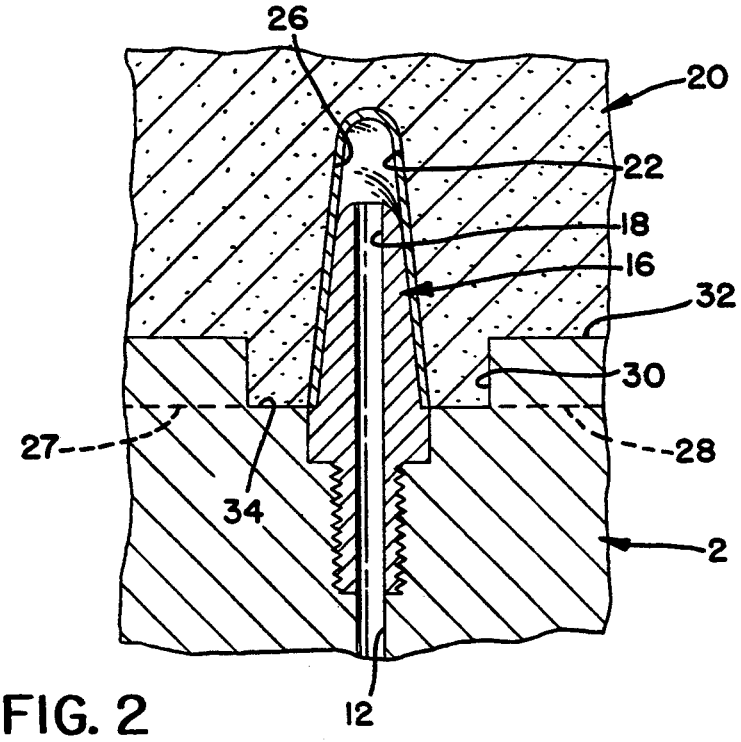
FIG. 2 is an enlarged view of a hollow mounting pin in accordance with the present invention.

The several figures illustrate a first male die segment 2 mating with a second female die segment 4 (shown in phantom) to define a mold cavity 6 therebetween. The die segment 2 includes a plurality of metal mandrels 8 for forming a plurality of combustion chambers in an internal combustion engine block formed when metal is cast into the cavity 6. The mandrels 8 are appropriately secured to the die 2 and abut the face 10 of the female die segment 4. The die segment 2 has passageways 12 formed therein and communicating with a source of vacuum (not shown) via pipe 14. The passageway 12 communicates with hollow mounting pins 16 which are screwed or otherwise anchored to the face 32 of the die segment 2. The mounting pins 16 have a longitudinal bore 18 extending through the center thereof in alignment with the passageway 12.

A resin-bonded sand core 20 has recesses 22 formed therein at the time the core is formed (e.g., in the core-forming mold), which recesses 22, except for their depth, conform substantially to the shape of the pins 16. The core 20 is positioned on the die segment 2 so that the recesses 22 mate with the hollow pins 16, and the core 20 is spaced from the mandrels 8 in the molding cavity 6 when the die is closed. In the case of an aluminum engine block, a cast iron liner 24 may be positioned over the mandrel 8. However, if the block were cast from hypereutectic Al—Si alloy, or the like, such a liner could be eliminated. The inner surface 26 of the recess 22 is treated to substantially reduce the porosity thereof and thereby enhance the effectiveness of the vacuum acting thereon via the bore 18 in the pin 16. In this regard, this surface 26 may be impregnated by, or coated with, any suitable material capable of withstanding the casting temperatures involved. The surface 26 will preferably be treated with sodium silicate (i.e., water glass) which upon heating cures to form a substantially impervious siliceous coating. Ceramic core coatings or high temperature polymers (e.g., epoxies or polyimides) may also be useful.

Figure 3:
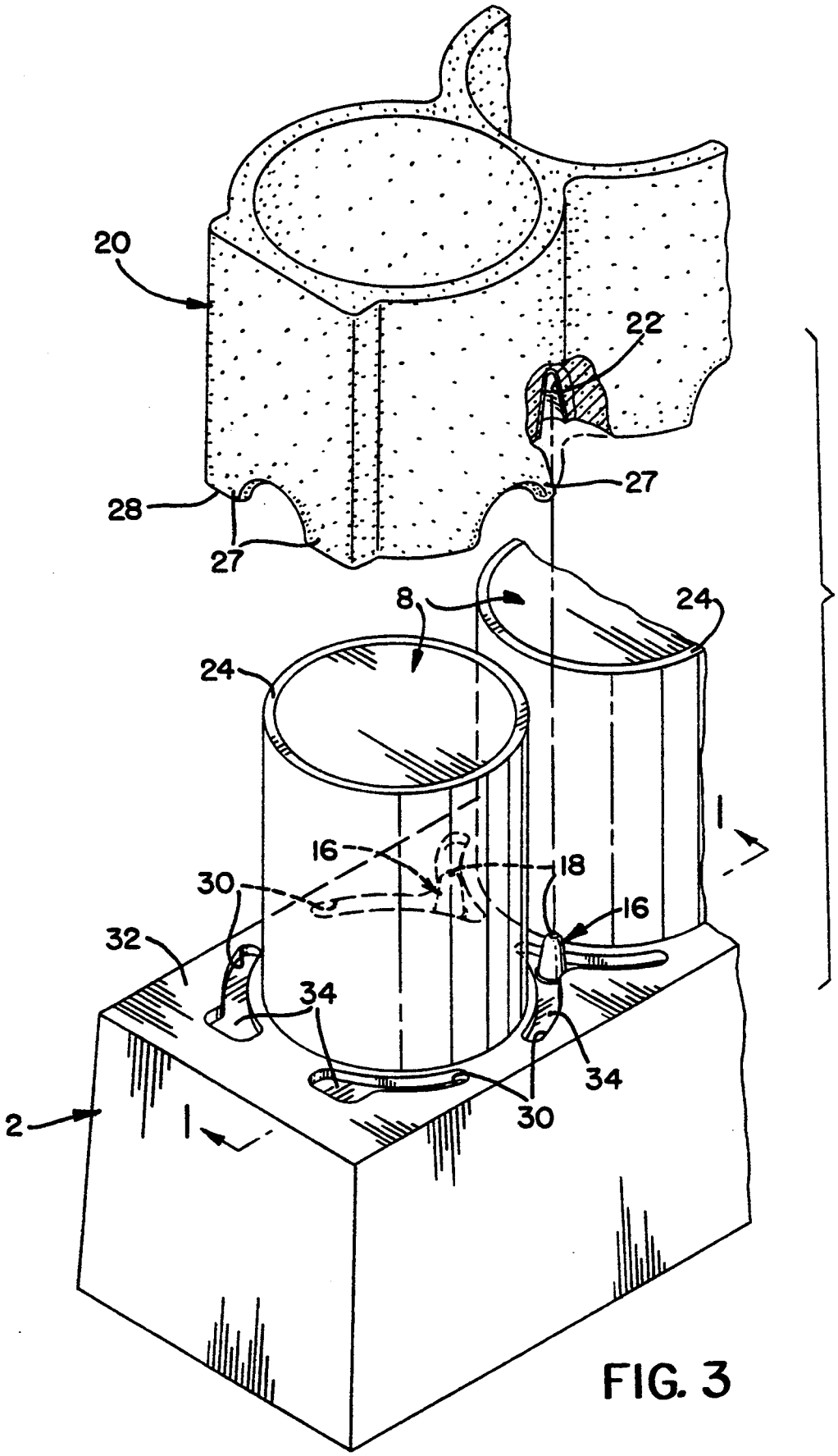
FIG. 3 is an exploded, perspective view of a die segment and expendable core poised for mounting in accordance with the present invention.

As best shown in FIG. 3, the core 20 includes several tabs 27 on the mounting end 28 of the core 20. The tabs 27 serve as print-outs and mate with core print depressions 30 formed in the face 32 of the die segment 2. The mounting pins 16 may be mounted to the die face 32, but will preferably be mounted to the floor 34 of the core print depressions 30 and mate with recesses 22 which are formed in the ends of tabs 27 which fit into such depressions 30. The surface 32 of the die 2 serves to form the surface of the engine block to which the engine heads are bolted, and in connection therewith, the tabs 27 provide a dual function. In the first place, nesting of the tabs 27 in the core print depressions 30 helps to accurately position and anchor the core 20 in place on the die 2. In the second place once the block has been cast and removed from the die, the tabs 27 project from the surface of the block and form openings in such surface through which the expendable core material 20 can be removed. In this regard, the tabs are merely knocked or ground off to expose the openings in the block's surface. Salt cores may then be removed by simply flushing out the cooling jacket in the block with hot water to dissolve out the salt. Resin-bonded-sand cores, on the other hand, may be disintegrated by vibration and shaken out of the water jacket through the openings in the face of the block formed by the tabs 27.

While the invention has been described primarily in terms of a specific embodiment thereof, it is not intended to be limited thereto but rather only to the extent set forth hereafter in the claims which follow.

The embodiments of the invention in which an exclusive property or privilege is claimed is defined as follows:

1. A method for positioning an expendable core in a molding cavity defined by a plurality of die segments forming a permanent molding die comprising the steps of:

a. forming an internal passageway in at least one of said segments;

b. anchoring at least one mounting pin on a face of said segment such that said pin projects into said cavity, said pin having a bore extending therethrough in alignment with said passageway;

c. forming a recess in said core conforming substantially to the external shape of said pin and adapted to mate with said pin;

d. positioning said core on said segment such that said pin nests in said recess; and e. drawing a vacuum in said passageway, bore and recess sufficient to anchor said core securely in place on said pin.

2. A method according to claim 1 wherein said recess is deeper than said pin is long so as to provide an extended interior surface of said recess exposed to said vacuum near the bottom of said recess.

3. A method according to claim 2 wherein said expendable core is porous, and including the step of treating said extended interior surface to reduce the porosity of said surface.

4. A method according to claim 3 wherein said treating comprises depositing a substantially impermeable coating on said interior surface.

5. A method according to claim 3 wherein said treating comprises impregnating said interior surface with an impregnate adapted to render said interior surface substantially non porous.

6. In a die casting die comprising a plurality of die segments cooperating in a die-closed position to define a molding cavity for shaping molten metal into a casting having a desired configuration conforming to the shape of said cavity, and an expendable core positioned in said cavity for forming a chamber within said casting following removal of said core from said casting, the improvement comprising:

a. a passageway in one of said die segments for connecting to a source of vacuum;

b. at least one mounting pin projecting from a face of said die segment into said cavity;

c. a recess in said core conforming substantially to the external shape of said pin, said recess receiving said pin in close fitting relation; and d. a bore extending through said pill and in alignment with said passageway for applying vacuum to the interior surface of said recess to anchor said core to said segment.

7. A die casting die according to claim 6 wherein said core has a tab defining a print-out extending therefrom and mating with a depression defining a core print in said segment.

8. A die casting die according to claim 7 wherein said pin is located in said depression and said recess is located in said tab.

9. A die casting die according to claim 6 wherein said recess is deeper than said pin is long so as to provide an extended interior surface of said recess exposed to said vacuum near the bottom of said recess.

10. A die casting die according to claim 6 wherein said segment includes a permanent metal mandrel and said expendable core surrounds said permanent metal mandrel.

11. A die casting die according to claim 6 wherein said expendable core is porous and including a deposit on the internal surface of said recess for rendering said interior surface substantially nonporous.

12. A die according to claim 11 wherein said deposit is a coating on said surface.

13. A die according to claim 11 wherein said deposit impregnates said internal surface.

14. A method of making a block for a liquid-cooled internal combustion engine, said block defining at least one cylindrical combustion chamber and a cooling jacket surrounding said combustion chamber and separated from said combustion chamber by a cylinder wall, comprising the steps of:

a. providing an expendable core conforming to the shape of the cooling jacket, said core having a mounting end, a distal end remote from said mounting end, and an internal annular wall extending between said ends and defining a cylindrical opening in said core;

b. providing a plurality of die segments which together, in a die-closed position, form a permanent molding die defining a molding cavity for shaping said block, at least one of said die segments having a face from which a cylindrical mandrel projects for forming said combustion chamber, said mandrel having an external surface;

c. forming an internal passageway in said one die segment;

d. anchoring at least one mounting pin on a face of said one die segment such that said pin projects into said cavity adjacent said mandrel, said pin having a bore extending therethrough in alignment with said passageway;

e. forming a recess in said mounting end of said core adapted to mate with said pin;

f. positioning said core around said mandrel such that said internal annular wall is substantially uniformly spaced from the external surface of said mandrel, and said recess mates with said pin;

g. drawing a vacuum in said passageway, bore and recess sufficient to anchor said mounting end of said core securely in place on said pin;

h. closing said molding die;

i. casting molten metal into said cavity about said core;

j. removing said block from said molding die following solidification of said metal; and k. removing said expendable core from the block so as to provide said cooling jacket about said combustion chamber.

15. A method according to claim 14 wherein said core includes at least one tab defining a print-out on said one end, said die face has at least one depression therein defining a core print, and said method includes the step of inserting said print-out in said core print during said positioning.

16. A method according to claim 15 wherein said recess is located in said tab and is positioned on a mounting pin located in said depression.

17. A method according to claim 14 wherein said mounting end of said core includes at least one tab defining a print-out extending therefrom and mating with a depression defining a core print in said segment, said tab(s) serving to form an opening(s) in a surface of said block, and removing said core from said block through said opening(s).

* * * * *